US006151836A

United States Patent [19]

McGlothlin et al.

[11] Patent Number: 6,151,836

[45] Date of Patent: Nov. 28, 2000

[54] GUTTER SYSTEM

[76] Inventors: W. Neal McGlothlin; Carlice M. McGlothlin, both of 7898 Rogues Rd., Catlett, Va. 20119-9013

[21] Appl. No.: 08/961,203

[22] Filed: Oct. 30, 1997

[51] Int. Cl.[7] ..... E04D 13/064

[52] U.S. Cl. ..... 52/11; 52/12; 52/16; 52/95; 52/302.1; 248/48.1

[58] Field of Search ..... 52/11, 12, 16, 52/302.1, 95; 248/48.1

[56] References Cited

U.S. PATENT DOCUMENTS

| | | | |
|---|---|---|---|
| 269,297 | 12/1882 | Kozer . | |
| 873,407 | 12/1907 | Behl . | |
| 2,109,447 | 2/1938 | Sadtler . | |
| 2,120,395 | 6/1938 | Dean . | |
| 2,271,081 | 1/1942 | Layton . | |
| 2,423,923 | 7/1947 | Audino . | |
| 2,583,422 | 1/1952 | Haddon . | |
| 2,633,610 | 4/1953 | Hervey . | |
| 2,672,832 | 3/1954 | Goetz | 248/48.1 |
| 2,674,961 | 4/1954 | Lake . | |
| 2,851,969 | 9/1958 | Teutsch . | |
| 2,935,954 | 5/1960 | Matthews et al. . | |
| 3,053,393 | 9/1962 | McLean . | |
| 3,080,682 | 3/1963 | Teutsch . | |
| 3,388,555 | 6/1968 | Foster | 52/12 |
| 3,777,649 | 12/1973 | Luckey | 52/95 |
| 4,254,594 | 3/1981 | Hammond et al. . | |
| 4,385,010 | 5/1983 | Bosne . | |
| 4,411,110 | 10/1983 | Carey . | |
| 4,416,835 | 11/1983 | Bosne . | |
| 4,418,504 | 12/1983 | Lassiter . | |
| 4,435,925 | 3/1984 | Jefferys | 52/12 |
| 4,467,570 | 8/1984 | Kriegel . | |
| 4,631,875 | 12/1986 | Olson | 52/12 |
| 4,667,448 | 5/1987 | Smith . | |
| 4,727,689 | 3/1988 | Bosler . | |
| 4,905,427 | 3/1990 | McPhalen | 52/12 |
| 4,912,888 | 4/1990 | Martin . | |
| 5,099,620 | 3/1992 | Carey | 52/12 |
| 5,189,849 | 3/1993 | Collins | 52/12 |
| 5,345,727 | 9/1994 | McCrea . | |
| 5,383,310 | 1/1995 | Sapia | 52/12 |
| 5,417,015 | 5/1995 | Coyne | 52/11 |
| 5,557,891 | 9/1996 | Albracht | 52/12 |
| 5,660,001 | 8/1997 | Albracht | 52/12 |

*Primary Examiner*—Carl D. Friedman
*Assistant Examiner*—Phi Dieu Tran A

[57] ABSTRACT

The present invention discloses in certain aspects a gutter system for connection to a structure, the structure having a top, the gutter system for receiving water flowing from the top of the structure, the gutter system having a hollow body member having a length, the hollow body member having a rear member having an upper end and a lower end, at least one step member projecting out and away from the rear member, the at least one step member extending along the length of the hollow body member, the at least one step member having an outer edge and a top surface, a front side connected at a top thereof to the outer edge of the at least one step member and at a bottom thereof to the lower end of the rear member, at least one drain hole through the front side for exit of water from within the hollow body member, and a plurality of fluid flow slots through the hollow body to permit fluid to flow into the hollow body at a lower end of the at least one step member.

13 Claims, 6 Drawing Sheets

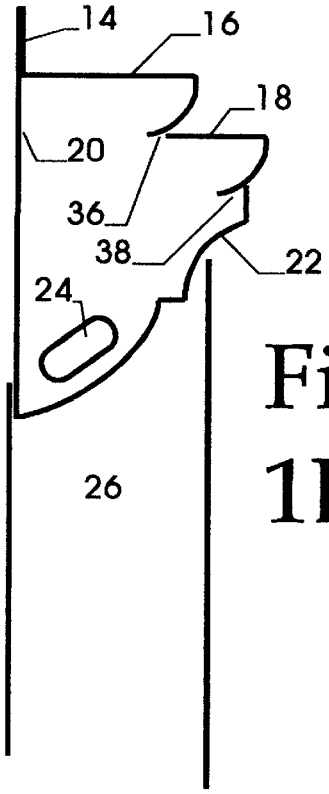
Fig. 1B
Fig. 1C
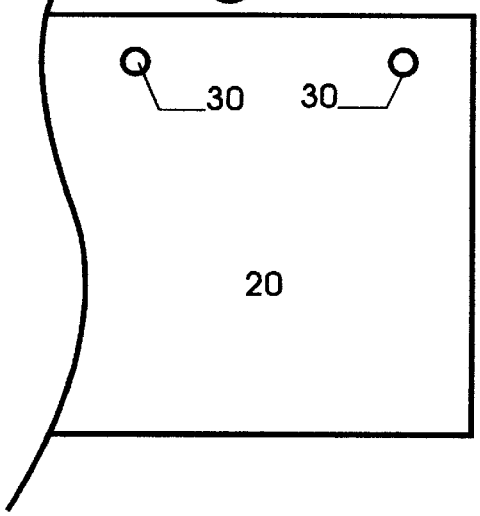
Fig. 1D
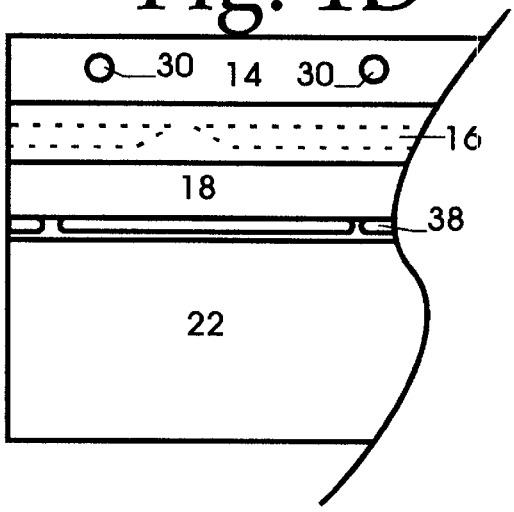
Fig. 1E
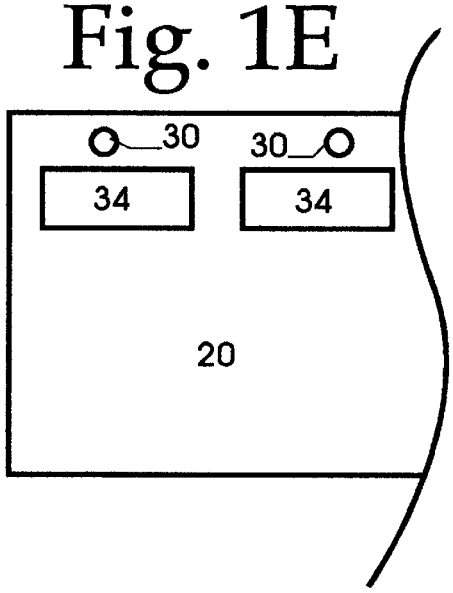

GUTTER SYSTEM

BACKGROUND OF THE INVENTION

1. Field Of The Invention

This invention is directed to building gutters, to methods for attaching a gutter to a building.

2. Description of Related Art

The prior art discloses a wide variety of gutters, gutter systems, and eave troughs, many of which have a lower trough member open at the top for receiving water flowing from above, generally from a sloping roof. Examples of such gutters, etc. are shown in U.S. Pat. Nos. 4,416,835; 4,385,010; 4,254,594; and 873,407.

The prior art also discloses a wide variety of gutters and troughs that include an enclosed hollow body with flow openings in the top or in the front side. Such items are disclosed in U.S. Pat. Nos. 5,345,727; 4,912,888; 4,727,689; 4,667,448; 4,631,875; 4,457,570; 4,435,925; 4,418,504; 4,411,110; 3,080,682; 3,053,393; 2,935,954; 2,851,969; 2,674,961; 2,583,422; 2,423,923; 2,271,081; and 2,120,395. Some of these patents disclose a system with a member that extends from a roof and covers or overlaps a gutter; e.g. U.S. Pat. Nos. 4,667,448; 4,631,875;4,435,925; 4,418,504; 3,080,682; 3,053,393; 2,935,954; 2,851,969; 2,674,961; 2,583,422.

There has long been a need for an effective and efficient building gutter system that is easily attached to a building, that simplifies building construction, and that adequately collects and conveys water flowing from a roof while inhibiting clogging by debris and leaves.

SUMMARY OF THE PRESENT INVENTION

The present invention, in certain embodiments, discloses a gutter system which is attachable to a building which has a hollow body for receiving water; an upper surface with at least two sub-surfaces; one sub-surface at a different level than the other, two sub-surfaces meeting along a boundary along which are a plurality of spaced-apart elongated slots through which water can flow to the interior of the hollow body. In one aspect the hollow body includes a rear side that serves as a fascia for a building so that no other fascia member is required, or which can be used with a typical fascia member. Optional flow slots may be located on the subsurfaces themselves.

Certain embodiments of a gutter as described above have a front member that extends down from the upper surface down to an exit downspout. In one aspect the rear side has one or more vent openings to inhibit the trapping of moisture between the rear side and a building. These vent openings may also, in certain embodiments, provide an exit route for hot air (e.g. in an attic) and an entry point for cool air. When warm air in a building, e.g. in an attic, rises and escapes through vent openings, the rear portion of the gutter at least is heated thereby, inhibiting or preventing ice formation on the gutter and/or snow accumulation therein and/or thereon. Optional flexible or stationary tabs on the side and/or at the bottom of the rear side with nails, brads, rivets, or screws therethrough may be used to attach the gutter's lower end to the building. Alternatively, the weight of the system alone keeps it against the building. Gutter systems according to the present invention may be made of any suitable material including, but not limited to, plastic and metal, including but not limited to aluminum and aluminum alloys.

Any gutter system disclosed herein may be made with well-known seamless gutter producing machines.

In another aspect an upright member extends upwardly from the upper surface at the rear thereof to provide a member through which fasteners can be inserted to attach the upper part of the gutter to the building.

The present invention discloses, in certain aspects, a gutter system for connection to a structure, the structure having a top, the gutter system for receiving water flowing from the top of the structure, the gutter system having a hollow body member having a length, the hollow body member having a rear member having an upper end and a lower end, at least one step member projecting out and away from the rear member, the at least one step member extending along the length of the hollow body member, the at least one step member having an outer edge and a top surface, a front side connected at a top thereof to the outer edge of the at least one step member and at a bottom thereof to the lower end of the rear member, at least one drain hole through the front side for exit of water from within the hollow body member, and a plurality of fluid flow slots through the hollow body to permit fluid to flow into the hollow body at a lower end of the at least one step member; such a gutter system wherein the outer edge of the at least one step member is releasably connected to the top of the front side; any such gutter system wherein the hollow body member is a unitary integral piece; any such gutter system wherein the at least one step member is a plurality of at least two step members, a first step member and a second step member, the second step member below the first step member, the second step member projecting further out from the rear member than the first step member, and the gutter system including a plurality of fluid flow slots disposed along a juncture of a bottom of the first step member and a top of the second step member; any such gutter system wherein the first step member has a protruding portion projecting outward and the plurality of fluid flow slots are closer to the rear member than the protruding portion; any such gutter system also including the front side having a decorative molding-like portion; any such gutter system wherein the front side inclines down to the lower end of the rear member and the at least one drain hole is through an inclined portion of the front side; any such gutter system with a top member connected to or formed integrally of the rear member and extending upwardly from the rear member and above a top surface of the at least one step member; any such gutter system with a plurality of vent openings through the rear member for alignment with at least one opening of the structure to vent a space within the structure; any such gutter system wherein material bent out from the rear member to form the vent openings is bent within the hollow body member; any such gutter system with a plurality of fluid flow holes through the top surface of the at least one step member for fluid flow through the top surface into the hollow body member; any such gutter system with at least one connection tab connected to the rear member for connecting the rear member to the structure; any such gutter system wherein the top surface of the at least one step member or of at least one step member is substantially level or in which the top surface of the at least one step member or of at least one step member is inclined downwardly and outwardly from the rear member; any such gutter system wherein the rear member is sized and positionable to be a fascia member of the structure; any such gutter system wherein the front side is inclined from a distal portion thereof down to the drain hole to facilitate fluid flow within the hollow body to the drain hole; any such gutter system wherein the hollow body has two ends, a first end and a second end, and in the gutter system the at least one drain hole is a first drain hole at the first end of the hollow body and a second drain hole at the second end of the hollow body.

The present invention, in certain aspects, discloses a gutter system for connection to a structure, the structure having a top, the gutter system for receiving water flowing from the top of the structure, the gutter system having a hollow body member having a length, the hollow body member having a rear member having an upper end and a lower end, at least one step member projecting out and away from the rear member, the at least one step member extending along the length of the hollow body member, the at least one step member having an outer edge and a top surface, a front side connected at a top thereof to the outer edge of the at least one step member and at a bottom thereof to the lower end of the rear member, at least one drain hole through the front side for exit of water from within the hollow body member, and a plurality of fluid flow slots through the hollow body to permit fluid to flow into the hollow body at a lower end of the at least one step member, the at least one step member being a plurality of at least two step members, a first step member and a second step member, the second step member below the first step member, the second step member projecting further out from the rear member than the first step member, the plurality of fluid flow slots disposed along a juncture of a bottom of the first step member and a top of the second step member, the front side inclined down to the lower end of the rear member and the at least one drain hole is through an inclined portion of the front side, a top member connected to or formed integrally of the rear member and extending upwardly from the rear member and above a top surface of the at least one step member, and a plurality of vent openings through the rear member for alignment with at least one opening of the structure to vent a space within the structure; such a gutter system wherein the hollow body member is a unitary integral piece, in one aspect formed with a seamless gutter making machine; and any such gutter system wherein the first step member has a protruding portion projecting outward and the plurality of fluid flow slots are closer to the rear member than the protruding portion, or in which at least one step member has a portion that overlies the fluid flow slots.

It is, therefore, an object of at least certain preferred embodiments of the present invention to provide:

New, useful, unique, efficient, nonobvious devices and methods for gutters and gutter installation procedures;

Such a gutter with multiple upper levels, two, three, four, or more with flow slots, slits, or openings on at least the lower level;

Such a gutter with a rear member that serves as a fascia plate or member;

Such a gutter with one or more vent openings in the rear side to provide: escape of moisture from between the gutter and the building; and/or to open to an attic or space under a roof to vent hot air therefrom and/or provide cool air entry therethrough, or vice versa; and Such a gutter with a sloped front side to facilitate the movement of water to an opening therethrough in fluid communication with a downspout.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1B is an end view of a gutter of the system of FIG. 1A. FIG. 1C is a rear view of the gutter of FIG. 1A. FIG. 1D is a front view of the gutter of FIG. 1A. FIG. 1E is a front view from inside the gutter of FIG. 1A of the rear side of the gutter.

DESCRIPTION OF EMBODIMENTS PREFERRED AT THE TIME OF FILING FOR THIS PATENT

Figure 1A:
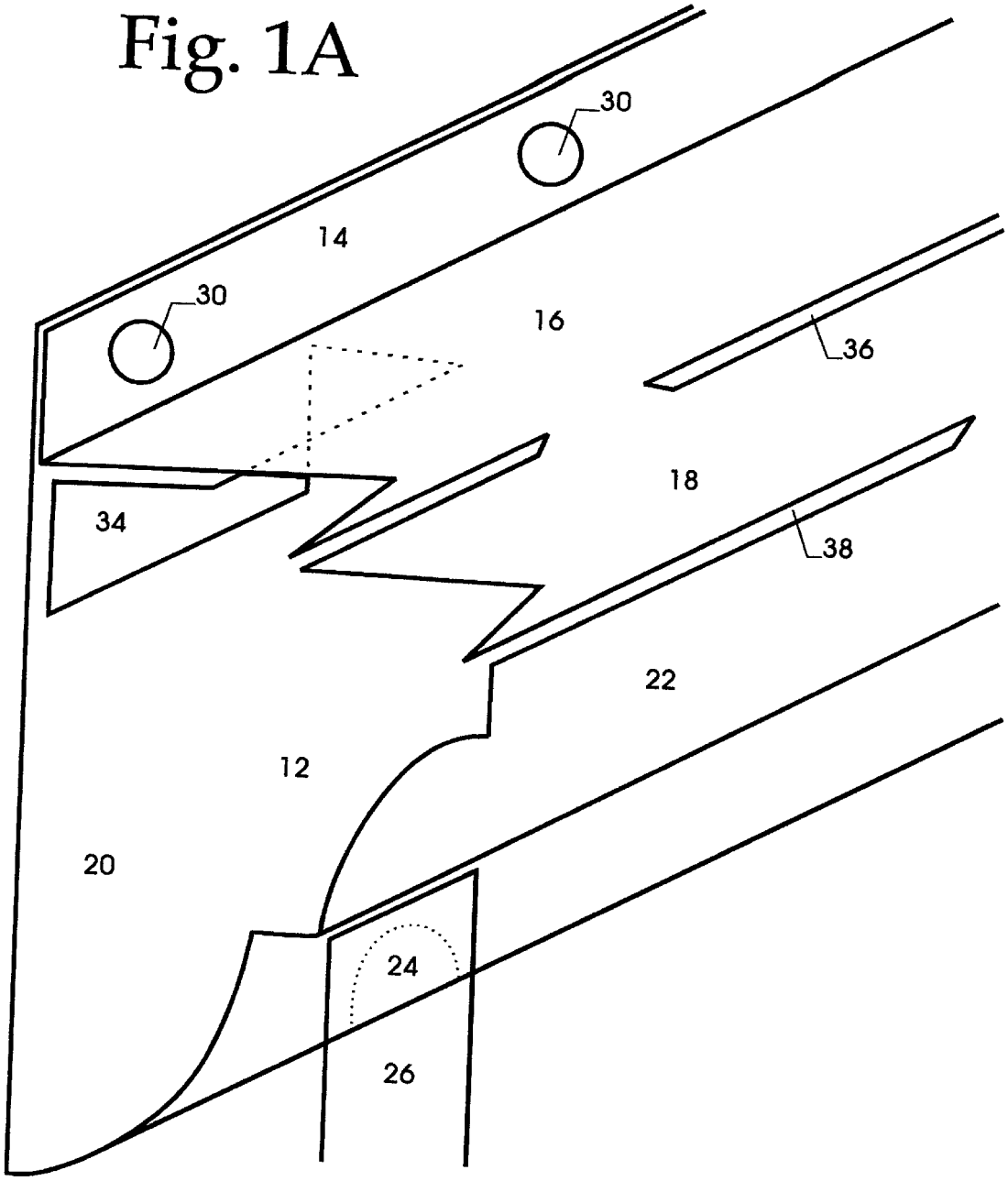
FIG. 1A is a perspective view of a gutter system according to the present invention.

FIGS. 1A–1E show a gutter system 10 according to the present invention which has a hollow body 12, an upright top member 14, a first step 16, a second step 18, a rear side 20, and a front side 22 that slopes inwardly and downwardly from the second step 18 to the bottom of the rear side 20. Alternatively the majority of the second step 18 may be deleted with only so much material remaining as is required to provide flow slots between the first step 16 and the front side 22. As shown the body 12 is an integral piece. It is within the scope of this invention for the body 12 (and the body of any system disclosed herein) to be made of multiple connected and/or attached pieces held together by suitable connectors, tape, and/or adhesives. For example and without limitation, the rear side 20 may be one piece and the top member 14, front side 22, and steps may be another piece.

An opening 24 in the front side 22 provides a flow path for water collected by the gutter to flow into a downspout 26. In one aspect, as shown, the opening 24 is larger in area than the cross-sectional area of the downspout 26. Alternatively, they may have a similar area or the downspout's area may be larger. In one aspect the gutter system's lower portion is substantially level along its entire length; and in another aspect the lower portion is inclined down to the opening 24.

Nails 28 extend through holes 30 into boards 32 of a building 40 to connect the gutter to the building. Alternatively an adhesive material may be used for this purpose (or used in addition to nails or screws in the holes 30). In one aspect, using holes 30, the gutter system is connected with screws to the ends of rafters of a building. Alternatively, a nail or screw can simply be pushed through the top member making its own hole.

In one preferred embodiment the gutter system 10 is disposed on the building 40 so that shingles 42 overlap the top upright member 14.

A plurality of vent openings 34 are disposed in the rear side 20 of the gutter system 10. A plurality of water flow slots 36 are located at the junction of the bottom of the first step 16 and the second step 18. Another series of water flow slots 38 are disposed in a front member below the second step 18. In one aspect the gutter system is placed over a side fascia board or other board and the vent openings 34 cover such a board. Alternatively the gutter system attaches like a fascia board and the vent openings open directly to space under a roof e.g. to an attic area. In one aspect in such an embodiment, the vent openings serve as soffit vents. Trash and debris flowing from the first step 16 onto the second step 18 is propelled away from and beyond slots 36 due to the recessed position of the slots with respect to the front rounded and extending portion of the first step 16.

Figure 1F:
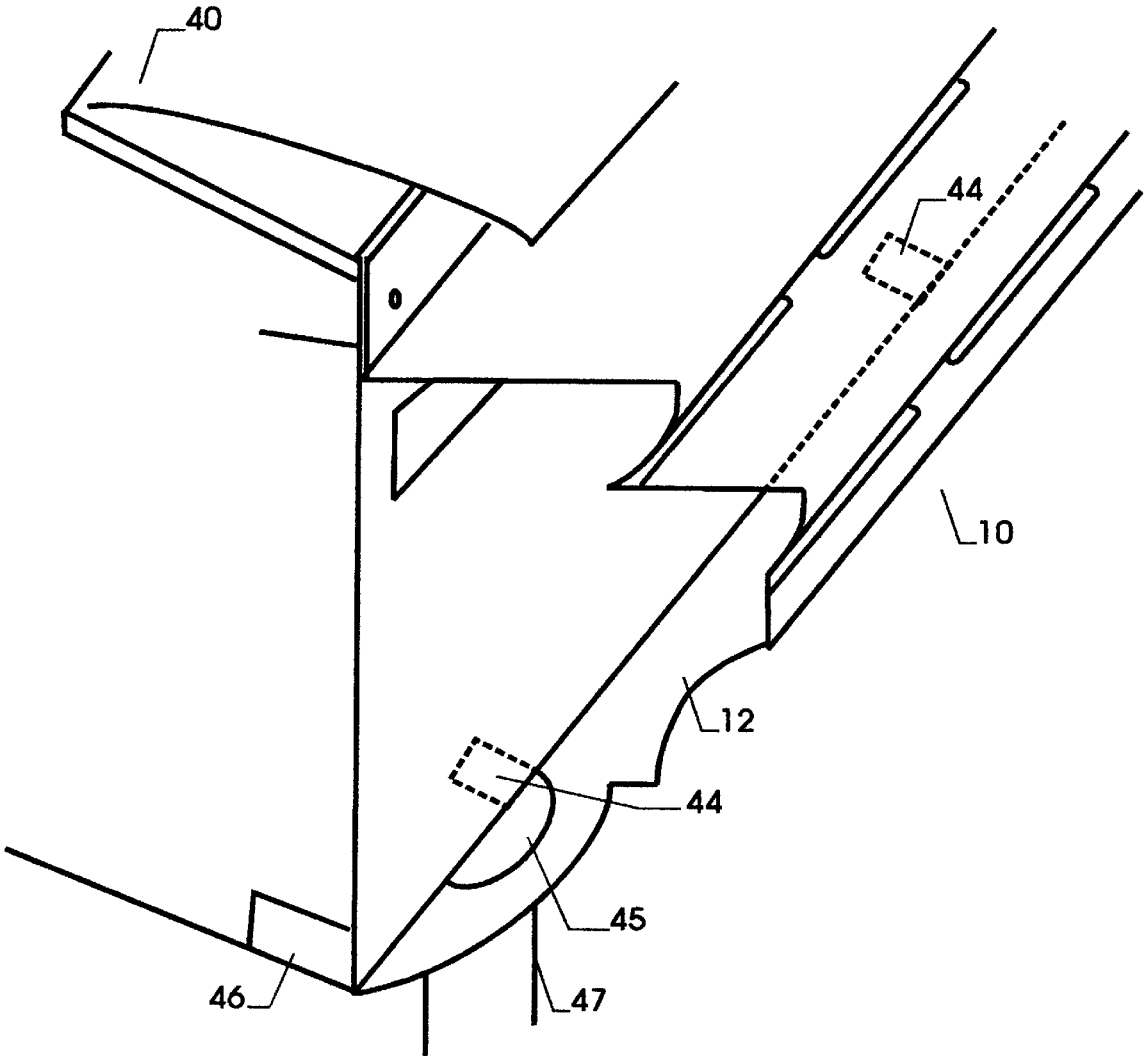
FIG. 1F is a perspective view of the gutter of FIG. 1A with tabs to facilitate attachment to a building.
Figure 1G:
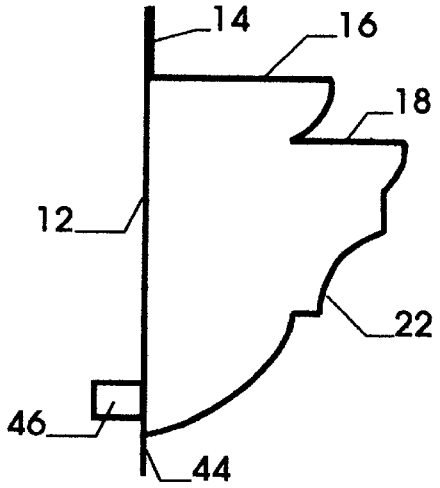
FIG. 1G is an end view of the gutter of FIG. 1F.

FIGS. 1F and 1G show an alternative embodiment of the system 10 with a plurality of lower tabs 44 and side tabs 46 (one shown; another at the other end of the gutter system, not shown). Adhesive may be used to attach such tabs to a building and/or a fastener (nail, screw, staple, etc.) may be installed through the tabs into the building. A flow opening 45 in the front side is communicates with a downspout 47 connected thereto.

In FIGS. 1A and 1F the far end of the gutter system 10 is not shown. It is to be understood that the body 12 may be any desirable length (as may be any gutter disclosed herein) and maybe made (e.g. extruded) as a single integral piece, or a plurality of pieces may be interconnected to form a gutter of a desired length. Alternatively, relatively long pieces of gutter (e.g. ten, fifteen, twenty, twenty-five feet long) can be provided at a job site and cut to a desired shorter length. In certain aspects such gutters are made of metal, PVC, or plastic. The cross-sectional area (e.g. as viewed from the end in FIG. 1B) may be any desired size, depending on the building and roof size. In one aspect the shingles 42 extend sufficiently to hide the nails 28 from view.

It is within the scope of this invention for the front side 22 to have angled and/or rounded sections 48 so that the entire front side of the gutter gives the appearance of a formed molding.

In one aspect the rear side of the gutter system is not backed with a board and this side alone serves as a fascia member that closes off an open area between the roof and walls of the building 40. In such an embodiment, the closed off open area is in communication with an attic of the building and heat in the attic in the winter warms the gutter to inhibit water freezing therein and to inhibit snow accumulation therein. In the summer hot air escapes from the attic through the vent openings 34 and cool air enters through them.

The general triangular shape of the gutter (as viewed from the end, FIG. 1B) is self-bracing and, all things being equal, such a gutter has less material than a typical three-sided rectangular shaped metal gutter. In one aspect a gutter according to the present invention with a particular top member width is about fifty percent lighter than such a conventional metal gutter with a bottom of the same width.

The first step 16 slows water hitting it and changes its direction. In one aspect up to about 80% of water hitting the first step, falls through the slots 36; in another aspect, at least 95%. The top member 14 can be connected directly to an end of a rafter of the building 40.

Figure 1H:
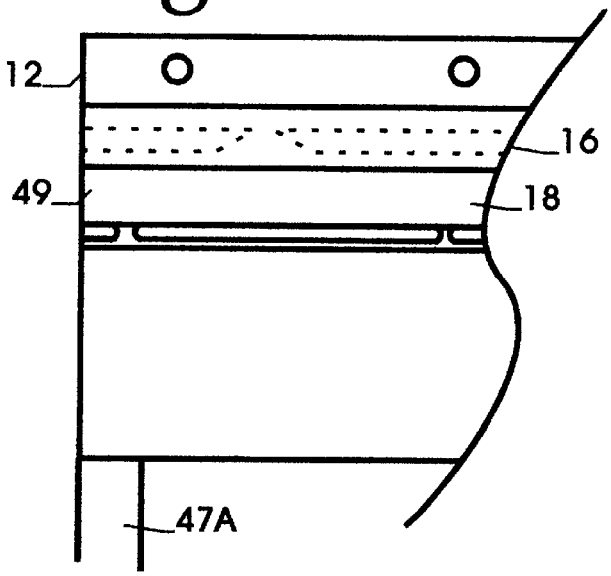
FIG. 1H is a front view of an alternative form of the gutter of FIG. 1A.

FIG. 1H shows an alternative front side 49 of the front side 22 in which the front side 49 slopes down from one (to the right in FIGS. 1G+H) to a lower end (to the left) at which a connection is made to a downspout 47*a* to facilitate water flow to the downspout 47*a*.

Figure 2:
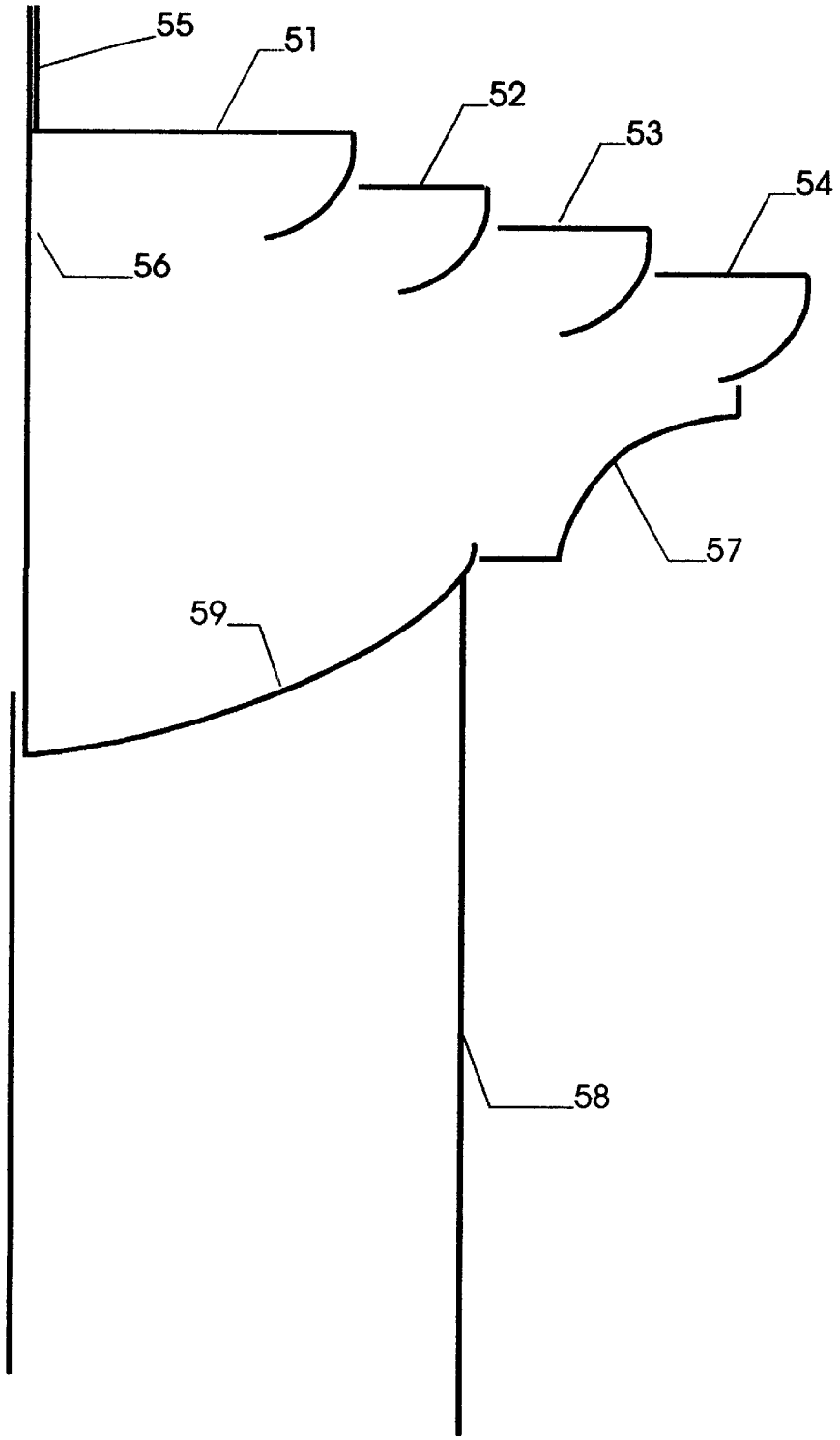
FIG. 2 is an end view of a gutter according to the present invention.

FIG. 2 shows a gutter system 50 (like the system 10), but with four step levels 51, 52, 53, 54, with flow slots (not shown) at the junction of each step level. The gutter system 50 has a top member 55 (like the member 14, FIG. 1A); a rear side 56 (like the rear side 20, FIG. 1A); and a sloping front side 57. The front side 57 may have angled or rounded portions to give the appearance of a molding.

Figure 3:
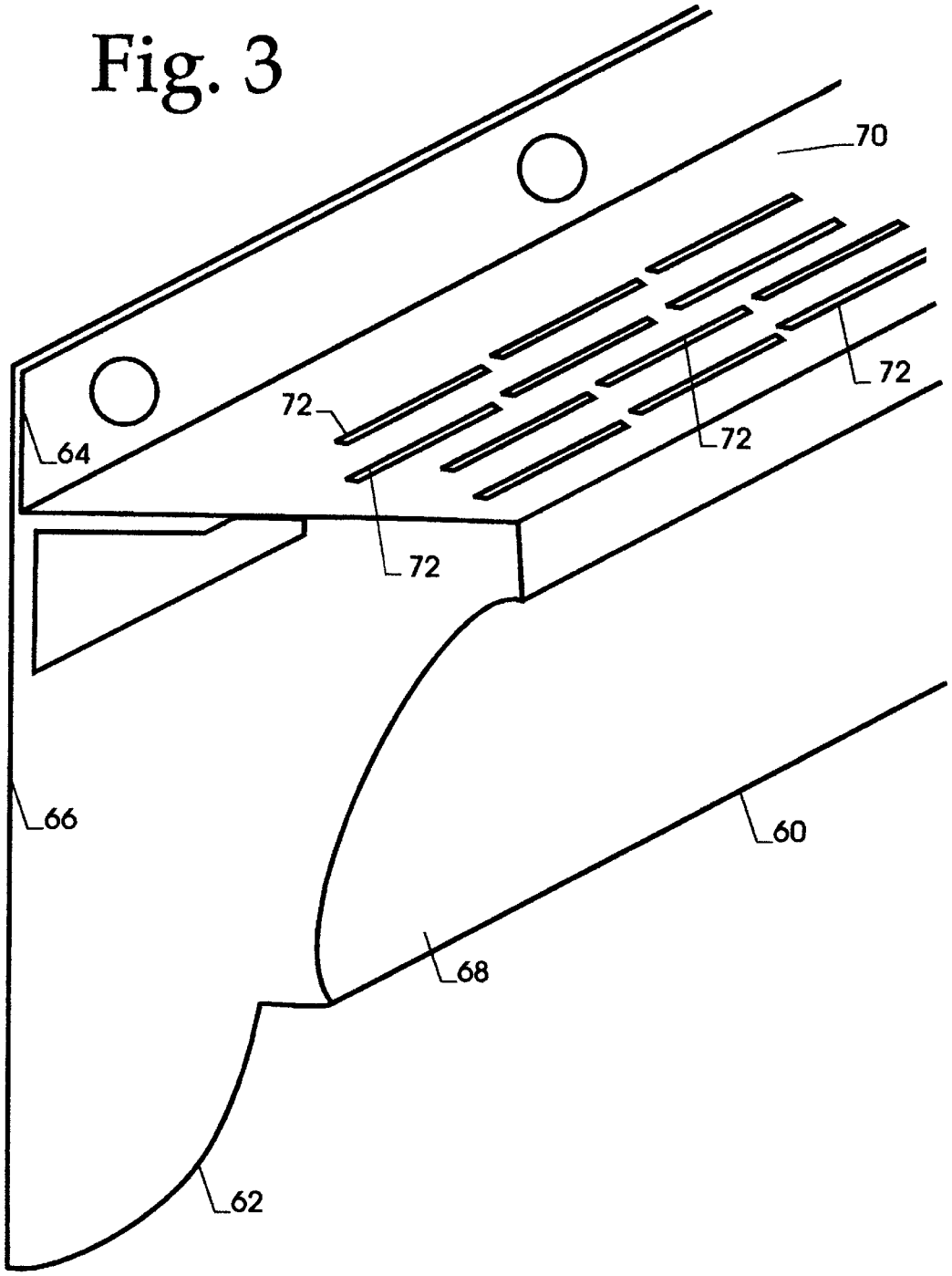
FIG. 3 is a perspective view of a gutter according to the present invention.

FIG. 3 shows a gutter system 60 with a body 62; an upright top member 64 (like the member 14, FIG. 1A); a rear side 66 (like the rear side 20, FIG. 1A); and a front side 68 (like the front side 22, FIG. 1A). A top member 70 has multiple series of water flow slots 72. A series of vent openings 80 (one shown) are formed by appropriately cutting or piercing the rear side 66 and then bending upwardly portions 81 (or, alternatively, portions 81 may be severed and removed). The series of vent openings 80 extends along the length of the system 60 or on a portion thereof. A downspout 61 is connected to a downspout opening 63. An optional second downspout 61*a* at a drain hole 63*a* may be used (or on any other system herein). A top lip 83 of the top member 71 releasably underlies a top end 81 of the front side 68. Upon release, the top member 71 may be raised for access to the interior of the body 62. Such a structure may be used with any system disposed herein.

It is within the scope of this invention to use screening or mesh, e.g. of metal, or plastic, mounted over to cover and/or behind each vent opening of each gutter system disclosed herein.

Figure 4:
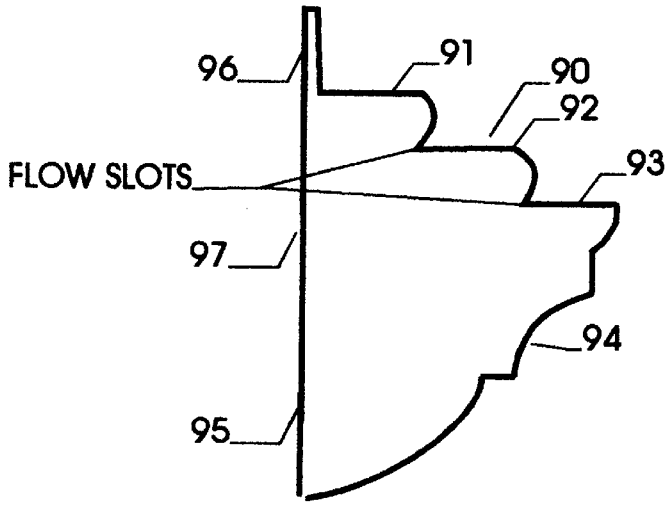
FIG. 4 is an end view of a gutter according to the present invention.

FIG. 4 shows in cross-section a gutter system 90 similar to the elongated gutter systems of FIG. 1A and FIG. 2, but with inclined steps 91, 92, and 93, and, unlike the gutter system 50 which as shown has multiple steps, a front molding-like portion 94 of a body 95. An upper member 96 is like the top member 55 (FIG. 2) and may have holes in it as desired for screws, nails, or bolts, to secure the system to a board, boards, or rafters. A downspout opening and downspout may be provided like those of the system of FIG. 1A. The molding-like portion 94 may be any desirable and/or aesthetically pleasing shape. A rear member 97 extends between the top member 96 and a lower end of the molding-like portion 94. Alternatively, the steps 91, 92, 93 may have their top surfaces substantially level (and the steps of the system 50 may be inclined). Flow slots (like the slots 36) are provided at the juncture of steps 91 and 92, and 92 and 93.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A gutter system for connection to a structure, the structure having a top, the gutter system for receiving water and debris flowing from the top of the structure wherein the water and debris are separated, said gutter system comprising a hollow body member having a length, the hollow body member having a rear member having an upper end and a lower end, a front side connected to said lower end of the hollow body member, at least one step member projecting out and away from the rear member, the at least one step member extending along the length of said hollow body member, and having a first edge and an outer edge said first edge, connected to said hollow body member, and said outer edge connected to said front side along a line defining a juncture, spaced drain openings being disposed along said juncture wherein water from said structure will pass through said holes into said hollow body and debris will pass over said step surface beyond said hollow body, at least one drain hole means through said front side for exit of water from within the hollow body member, said hollow body member being of substantially triangular shape in cross section to promote self cleaning.

2. The gutter system of claim 1 wherein the hollow body member is a unitary integral piece.

3. The gutter system of claim 1 wherein the front side inclines down to the lower end of the rear member and the at least one drain hole is through an inclined portion of the front side.

4. The gutter system of claim 1 further comprising a top member connected to or formed integrally of the rear member and extending upwardly from the rear member and above a top surface of the at least one step member.

5. The gutter system of claim 1 further comprising a plurality of vent openings through the rear member for alignment with at least one opening of the structure to vent a space within the structure.

6. The gutter system of claim 5 wherein material bent out from the rear member to form the vent openings is bent within the hollow body member.

7. The gutter system of claim 1 further comprising at least one connection tab connected to the rear member for connecting the rear member to the structure.

8. The gutter system of claim 1 further comprising the top surface of the at least one step member being substantially level.

9. The gutter system of claim 1 further comprising the top surface of the at least one step member being inclined downwardly and outwardly from the rear member.

10. The gutter system of claim 1 wherein the rear member is sized and positionable to be a fascia member of the structure.

11. The gutter system of claim 1 wherein the front side is inclined from a distal portion thereof down to the drain hole to facilitate fluid flow within the hollow body to the drain hole.

12. A gutter system for connection to a structure, the structure having a top, the gutter system for receiving water and debris flowing from the top of the structure, the gutter system comprising a hollow body member having a length, the hollow body member having a rear member having an upper end and a lower end, at least one step member projecting out and away from the rear member, the at least one step member extending along the length of the hollow body member, the at least one step member having an outer edge and a top surface, a front side connected at a top thereof to the outer edge of the at least one step member and at a bottom thereof to the lower end of the rear member, at least one drain hole through the front side for exit of water from within the hollow body member, and a plurality of fluid flow slots through the hollow body at a lower end of the at least one step member, the at least one step member is a plurality of at least two step members, a first step member and a second step member, the second step member being below the first step member, the second step member projecting further from the rear member than the first member, the plurality of fluid flow slots disposed along a juncture of the bottom of the first step member and a top of the second step member, the surface of said first step member projecting outward to define a rounded protuberance so that the fluid flow slots are closer to said rear member than the protuberance whereby fluid may flow over said protuberance and into said slots with debris being deflected beyond the protuberance, the front side inclined down to the lower end of the rear member and the at least one drain hole is through an inclined portion of the front side, a top member connected to the rear member and extending upwardly from the rear member and above a top surface of the at least one step member, and a plurality of vent openings through the rear member for alignment with at least one opening of the structure to vent a space within said structure, said rear member, said front side, and said step members all connected to define said hollow body member as being substantially triangular in cross-section to enhanced self-cleaning, said rear member with said vent openings adapted to function as a facia member in said structure, thus eliminating the need for a separate facia member.

13. A gutter system for connection to a structure, the structure having a top, the gutter system for receiving water and debris flowing from the top of the structure, the gutter system comprising a hollow body member having a rear member having an upper end and a lower end, means having an upper edge and an outer edge, said means having at least two step members projecting out and away from the rear member, said step members extending along the length of said hollow body member, a front side connected at a top thereof to the outer edge of said means and at a bottom thereof to the lower end of the rear member, said step members having upper surfaces with the upper surface of each step member lying in a different elevational plant and being located between said upper edge and said outer edge, the surfaces of adjacent step members meeting along a vertical boundary line defining a step between adjacent step members, the upper surface of each step member having a protruding portion projecting outward, a plurality of fluid flow opening means disposed beneath said protruding portion and within each step member wherein fluid will flow from the surface over the protruding portion into said fluid flow opening means and debris will be deflected therepast wherein the majority of fluid will be separated from the debris at the uppermost step member and the remainder of the fluid will be separated from the debris at the other step member, said fluid passing through said fluid flow openings into said gutter, said front side, said rear member and said step members all being connected to define said hollow body in cross-section with a triangular shape to enhance self-cleaning.

* * * * *